US005927031A

United States Patent [19]

Martin

[11] Patent Number: 5,927,031

[45] Date of Patent: Jul. 27, 1999

[54] STABILIZER FRAME FOR CORNER SIDING AND METHOD

[76] Inventor: Charlie R. Martin, 6440 George Hildebran School Rd., Hickory, N.C. 28602

[21] Appl. No.: 09/056,325

[22] Filed: Apr. 7, 1998

[51] Int. Cl.[6] ..... E04C 2/38

[52] U.S. Cl. ..... 52/288.1; 52/717.01; 52/718.04; 52/717.03; 52/717.05; 24/297

[58] Field of Search ..... 52/287.1, 288.1, 52/716.3, 716.4, 716.8, 717.01, 718.01, 718.04, 717.03, 717.05; 24/289, 297

[56] References Cited

U.S. PATENT DOCUMENTS

| | | | |
|---|---|---|---|
| 1,825,010 | 9/1931 | Murphy . | |
| 3,302,350 | 2/1967 | Brown et al. . | |
| 3,717,969 | 2/1973 | Olsen et al. | 52/288 |
| 3,742,668 | 7/1973 | Oliver | 52/288 |
| 4,104,839 | 8/1978 | Balzer et al. | 52/288 |
| 4,150,517 | 4/1979 | Warner, Sr. | 52/288 |
| 4,430,833 | 2/1984 | Balzer et al. | 52/255 |
| 4,706,426 | 11/1987 | Rumsey | 52/232 |
| 5,179,811 | 1/1993 | Walker et al. | 52/287 |
| 5,359,817 | 11/1994 | Fulton | 52/288.1 |
| 5,433,048 | 7/1995 | Strasser | 52/288.1 |
| 5,664,376 | 9/1997 | Wilson et al. | 52/287.1 |

*Primary Examiner*—Christopher Kent
*Assistant Examiner*—Yvonne Horton-Richardson

[57] ABSTRACT

A stabilizer frame enables a single worker to attach a strip of corner polymer siding to a building. The stabilizer frame includes a right-angled inward-facing surface which receives the corner siding exterior faces and also includes wall-engaging surfaces. The worker raises the strip of corner siding against the building and holds it with the stabilizer frame by one hand. The other hand may insert a tack into a slotted post provided on the frame and drive the tack through the corner siding into a building wall. The process is repeated to secure both edges of the corner siding throughout the length of the corner siding.

4 Claims, 2 Drawing Sheets

STABILIZER FRAME FOR CORNER SIDING AND METHOD

BACKGROUND OF THE INVENTION

This invention relates to, and more particularly pertains to a new and improved frame used in stabilizing plastic corner siding, and a method for using the frame.

Siding, or covering material, is sometimes placed over existing wood on the exterior of a building structure. The strips of siding protect the wood from the elements and prolong the useful life of the building.

Shown in FIG. 1 is a plan view of a prior art strip 20 (see FIG. 2) of corner siding formed of vinyl polymer material. The corner siding strip is typically placed in a vertical position on each of the corners of the building structure, with free ends 21 being fastened to the building by tacks or the like. The free ends 21 may be formed having vertical slots (not shown) to allow easy fastening of tacks. Corner 25 faces outward, and is flanked by exterior faces 24. Areas 23 are U-shaped to produce exterior channels 22. The ends of strips of siding are disposed in the exterior channels 22 and are fastened to the building structure.

The cooperative effort of two workers typically is required to affix the corner siding to the building. One person must hold the corner siding to the wall while the other person tacks the corner siding to the building. Even with the cooperative effort of two workers, the corner siding strip may assume an irregular shape, leaning toward one wall or the other wall of the building. Should this occur, the channels 22 may assume an irregular shape, which not only detracts from the attractiveness of the siding but may increase the difficulty of inserting ends of siding strips within the channels 22.

The prior art has provided blocks of material which may be inserted between the building and the corner siding strip. While such blocks help to minimize unwanted leaning, the blocks themselves must be transported to the workplace, raised against the building corner, and supported while the corner siding is tacked to the building walls. The blocks then must be removed if they are not to remain permanently between the building and the corner siding.

SUMMARY OF THE INVENTION

It is therefore an object of the present invention to provide a stabilizer frame which stabilizes the shape of the corner siding strip, thereby improving the appearance of the siding and reduces the difficulty of inserting siding strips within the exterior channels.

Another object is to provide such a frame which is lightweight, compact, and does not require insertion between the building and the corner siding.

Yet another object is to enable only one worker to properly affix corner siding to a building corner, thereby promoting efficiency and saving labor costs.

These and other objects are provided by a stabilizer frame comprising a plate and two slotted posts mounted perpendicular to said plate. The plate includes an upper surface, a lower surface, two ears, and a side surface. The plate side surface includes first and second siding-engaging faces which are perpendicular to each other and meet each other at a corner, and are suitable for fitting closely against the exterior faces of the corner siding strip. Curved portions in the side surface engage U-shaped portions of the corner siding which serve to allow formation of exterior channels in the corner siding. The plate side surface also includes first and second wall-engaging faces which are part of the plate ears.

One person may mount a strip of corner siding to a building corner by use of the following method. First, a strip of corner siding is stood upright against the building corner. The plate is placed around the strip of corner siding such that the siding-engaging faces and the curved areas of the sidewall engage the corner siding and prevent it from leaning toward one side of the building wall or the other. When the strip of corner siding is thus held between the building corner and the plate, the wall-engaging faces of the wall-engaging faces provided on the ears of the plate are supported by the building walls. While one hand is used to hold the plate in the position above described, the other hand may be used to fit a tack or other suitable fastener in a slot in one of the posts and drive the fastener into a building wall to secure the corner siding strip to the building. The hands then may be switched so as to allow a second fastener to be driven into the building, thus completing the task of securing an area of corner siding. The plate then may be moved upward or downward to complete the job of securing the strip of corner siding.

After the corner siding strip has been secured and the plate has been removed, free ends of strips of siding may be inserted into exterior channels of the corner siding strip and the siding strips then may be secured to the building by conventional methods.

BRIEF DESCRIPTION OF THE DRAWINGS

In order to facilitate a better understanding of the characteristics of the invention to those skilled in the art, a detailed description will be made on the basis of the accompanying drawings. Like numbers refer to like elements. The drawings are not necessarily drawn to scale.

DETAILED DESCRIPTION OF THE PREFERRED EMBODIMENT

Figure 1:
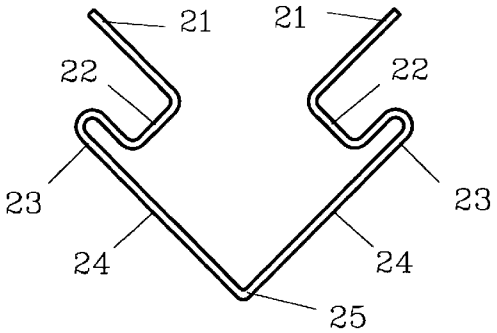
PRIOR ART FIG. 1
FIG. 1 shows a plan view of a prior art strip of corner siding.
Figure 5:
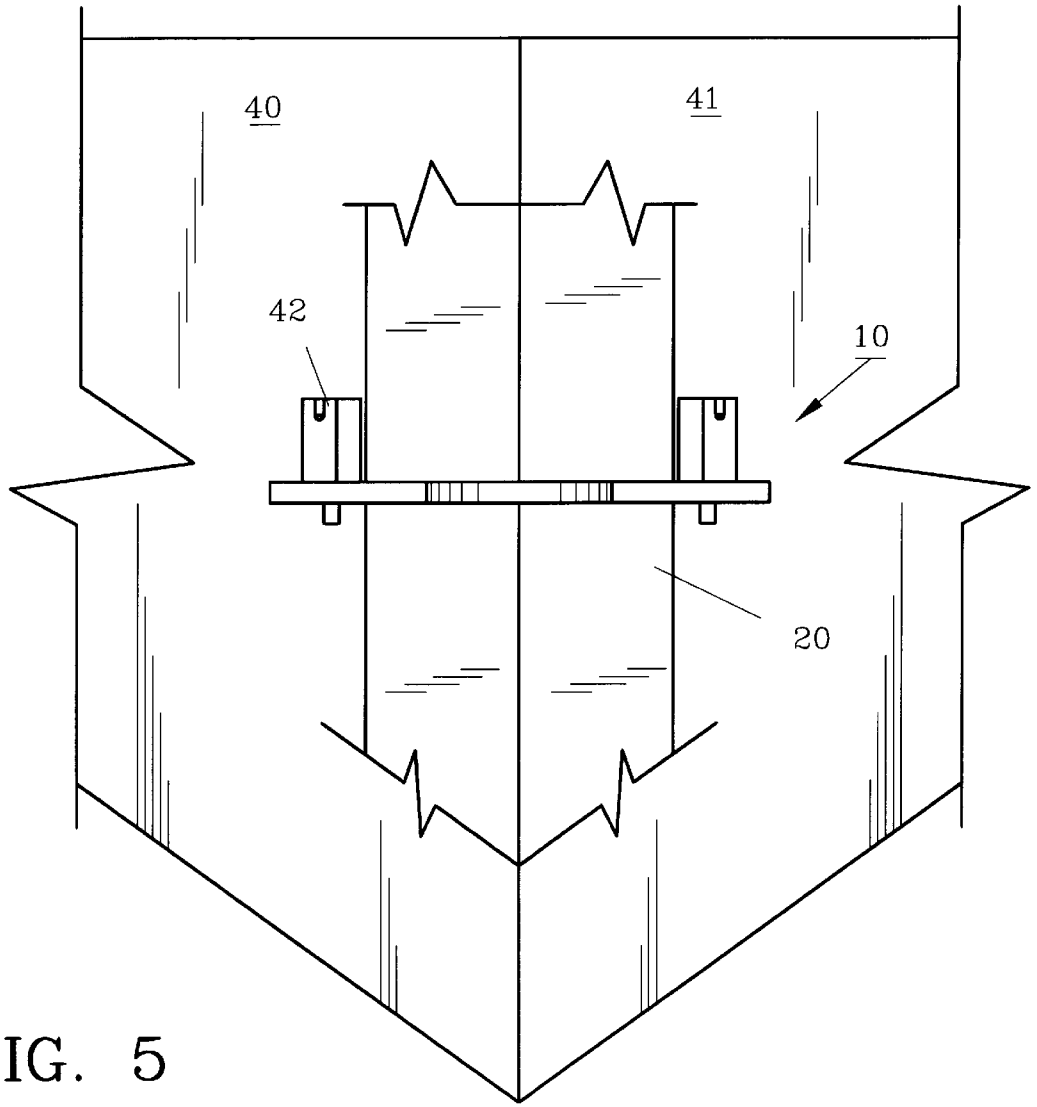

A prior art strip 20 of polymer corner siding is shown in plan view in FIG. 1 and in side elevational view in FIG. 5. The problem addressed by the invention is to provide a suitable stabilizer frame and method of securing the strip 20 to a building corner.

The strip 20 includes a corner 25 which faces outward and is flanked by exterior faces 24. Areas 23 are U-shaped to produce exterior channels 22, each of which is shaped to be open in a direction along which strips of siding are to be mounted to a building. Free ends 21 are suitable to be fastened to a building by tacks or the like. The free ends 21 may be formed having vertical slots (not shown) to allow easy fastening of tacks. Strip 20 is designed to be fastened to a building corner formed by walls 40, 41 in an upright position as shown in FIG. 5.

Figure 3:
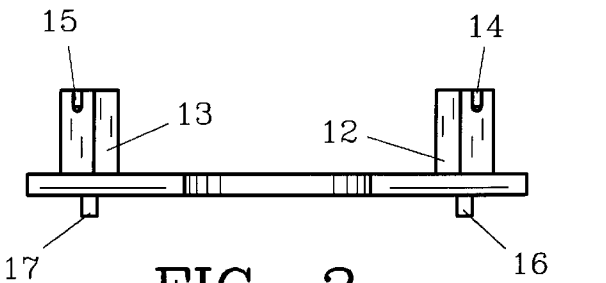
FIG. 3 shows a side elevational view of the stabilizer frame of FIG. 2.
Figure 2:
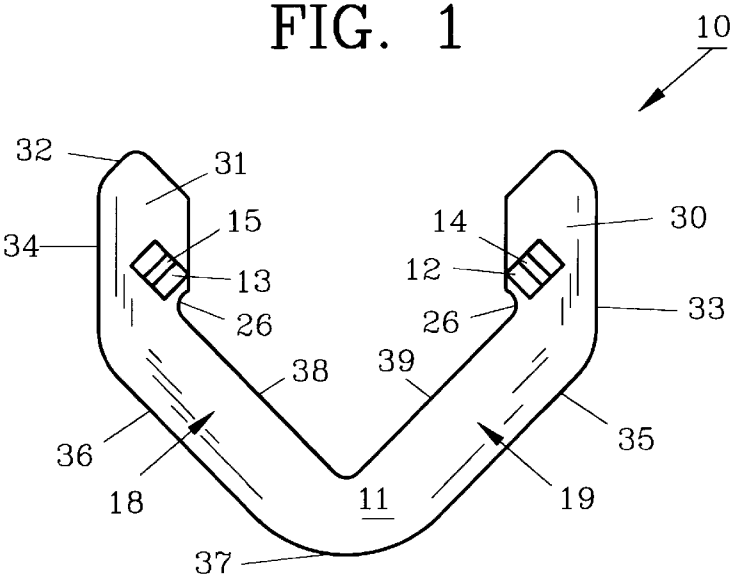
FIG. 2 shows a plan view of a stabilizer frame according to the invention.

A stabilizer frame 10, shown in FIGS. 2 and 3, is provided to allow a single worker to fasten strip 20 to a building corner. Stabilizer frame 10 includes a plate 11 and posts 12, 13 mounted by respective hex-wrench tightened fasteners 16, 17 to and extending perpendicular to the same side of plate 11. Posts 12, 13, are provided with respective open vertical slots 14, 15 for a purpose to be explained below.

Figure 4:
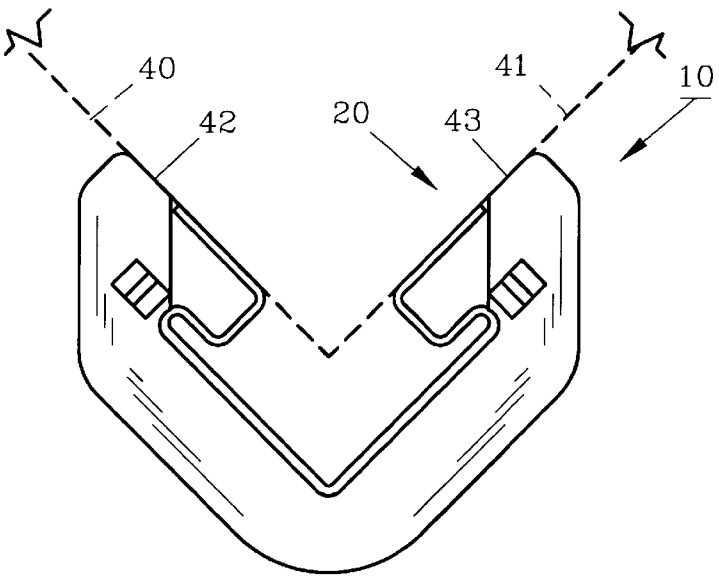
FIG. 4 shows a plan view of the stabilizer frame of FIG. 2 engaging a strip of corner molding; and, FIG. 5 shows a side elevational view of the stabilizer frame of FIG. 2 holding a strip of corner molding to be mounted to a building.

As seen in FIG. 2, stabilizer frame 10 is basically V-shaped with ears 30, 31 at its free ends. First and second siding-engaging side faces 18, 19 are perpendicular to each other and are adapted to engage corner siding exterior faces 24, as shown in FIG. 4. Curved side portions 26 are adapted to engage the U-shaped portions 23 of corner siding 20, also as shown in FIG. 4. First and second wall-engaging faces 19 provided on ears 30, 31 engage building walls 40, 41 when in use as shown in FIGS. 4 and 5. The outward-facing portions of the frame sidewall include smoothed corner 37, flat portions 35, 36 which respectively are parallel to faces 39, 38; flat surfaces 33, 34; and surfaces 32 which complete the sidewall of stabilizer frame 10.

The method of use of stabilizer frame 10 is described with reference to FIGS. 4 and 5. After corner strip 20 is raised against a building corner as shown in FIG. 5, stabilizer frame 10 is fitted against corner strip 20 in the position shown in FIG. 4, in which stabilizer frame surfaces 42, 43 rest against building walls 40, 41. While one hand is used to hold stabilizer frame 10, the other hand may be used to insert a tack in a post slot such as at 42 in FIG. 5. Then a hammer may be used to drive a tack through a slot in a siding free end 21 to secure the free end to the building. After repeating this procedure to secure the other free end 21, the stabilizer frame 10 may be moved up or down along corner siding strip 20 to secure it to the building throughout its length.

After corner siding strip 20 is secured, ends of prior art strips of siding are fitted in exterior channels 22 of corner siding strip 20. The prior art strips of siding then are secured to the building in the conventional manner.

Since the invention may be embodied in several forms without departing from the spirit or essential characteristics thereof, the preceding description is intended to be illustrative and not restrictive, since the scope of the invention is defined by the claims rather than by the description preceding them.

What is claimed is:

1. A stabilizer frame suitable for use in affixing a strip of corner siding to a building corner formed by two walls, said strip of corner siding including two exterior faces which are perpendicular to each other and which form a corner, and said strip of corner siding further including two free ends each suitable to be fastened to one of said building walls, said stabilizer frame comprising:

a plate having a side surface comprising first and second siding-engaging faces which are perpendicular to each other and are suitable for fitting closely against said corner siding strip exterior faces, and said side surface further comprising first and second wall-engaging faces which are perpendicular to each other and are each adapted to engage one of said building walls when said strip of corner siding is disposed between said building corner and said stabilizer frame; and, a first post mounted to said plate, said first post including a slot therein suitable for receiving a fastener to be driven through one of said corner siding free ends to secure said corner siding strip to said building.

2. A stabilizer frame as set out in claim 1, further comprising a second post mounted to said plate, said second post including a slot therein suitable for receiving a fastener to be driven through one of said corner siding free ends to secure said corner siding strip to said building.

3. A stabilizer frame as set out in claim 1, further comprising a curved portion at a distal end of each of said siding-engaging faces suitable for engaging curved portions of said strip of corner siding.

4. A method of attaching a strip of corner siding to a corner of a building, said strip of corner siding including two exterior faces which are perpendicular to each other and which form a corner, and said strip of corner siding further including two free ends each suitable to be fastened to one of said building walls, said method comprising:

disposing said strip of corner siding in an upright position facing said building corner;

stabilizing said corner siding exterior faces in a mutually perpendicular position by application of a frame thereto such that said exterior faces are engaged by said frame;

supporting a fastener in a slotted post provided on said frame; and, driving said fastener into said building to secure said corner strip to said building.

* * * * *